US008853584B2

(12) United States Patent
Roos et al.

(10) Patent No.: US 8,853,584 B2
(45) Date of Patent: Oct. 7, 2014

(54) METHODS FOR SORTING MATERIALS

(71) Applicant: Mineral Separation Technologies Inc., Coal Center, PA (US)

(72) Inventors: Charles E. Roos, Nashville, TN (US); Edward J. Sommer, Jr., Nashville, TN (US)

(73) Assignee: Mineral Separation Technologies Inc., Coal Center, PA (US)

( * ) Notice: Subject to any disclaimer, the term of this patent is extended or adjusted under 35 U.S.C. 154(b) by 0 days.

(21) Appl. No.: 14/082,165

(22) Filed: Nov. 17, 2013

(65) Prior Publication Data

US 2014/0069848 A1 Mar. 13, 2014

Related U.S. Application Data

(62) Division of application No. 12/712,343, filed on Feb. 25, 2010, now Pat. No. 8,610,019.

(60) Provisional application No. 61/208,737, filed on Feb. 27, 2009.

(51) Int. Cl.

| | |
|---|---|
| ***B07C 5/00*** | (2006.01) |
| ***B07C 5/34*** | (2006.01) |
| ***B07C 5/346*** | (2006.01) |

(52) U.S. Cl.

CPC ..... *B07C 5/3416* (2013.01); *B07C 5/346* (2013.01)

USPC ..... 209/576; 209/582; 209/589; 378/45; 378/53; 378/57; 250/358.1

(58) Field of Classification Search

USPC ..... 209/576, 582, 589; 378/45, 53, 57, 58, 378/88; 250/358.1, 359.1

See application file for complete search history.

(56) References Cited

U.S. PATENT DOCUMENTS

| | | | |
|---|---|---|---|
| 2,679,317 | A | 5/1954 | Roop |
| 3,270,204 | A | 8/1966 | Rhodes |

(Continued)

FOREIGN PATENT DOCUMENTS

| | | | |
|---|---|---|---|
| CN | 1125645 | A | 7/1996 |
| CN | 101214483 | A | 7/2008 |

(Continued)

OTHER PUBLICATIONS

"Sulfer dioxide and coal" (author unknown); http://www.sourcewatch.org/index.php?title=Sulfur_dioxide_and_coal; SourceWatch; pp. 1-6; Feb. 8, 2010.

(Continued)

*Primary Examiner* — Terrell Matthews

(74) *Attorney, Agent, or Firm* — Wyatt, Tarrant & Combs, LLP

(57) ABSTRACT

Disclosed herein is the use of differences in x-ray linear absorption coefficients to process ore and remove elements with higher atomic number from elements with lower atomic numbers. Use of this dry method at the mine reduces pollution and transportation costs. One example of said invention is the ejection of inclusions with sulfur, silicates, mercury, arsenic and radioactive elements from coal. This reduces the amount and toxicity of coal ash. It also reduces air emissions and the energy required to clean stack gases from coal combustion. Removal of said ejected elements improves thermal efficiency and reduces the pollution and carbon footprint for electrical production.

6 Claims, 10 Drawing Sheets

(56) References Cited

U.S. PATENT DOCUMENTS

| | | | | | |
|---|---|---|---|---|---|
| 3,448,264 | A | | 6/1969 | Rhodes | |
| 3,472,375 | A | | 10/1969 | Mathews, T.C. | |
| 3,655,964 | A | | 4/1972 | Slight | |
| 4,064,440 | A | | 12/1977 | Roder | |
| 4,090,074 | A | * | 5/1978 | Watt et al. | 378/88 |
| 4,377,392 | A | | 3/1983 | Massey et al. | |
| 4,462,495 | A | | 7/1984 | McKinley et al. | |
| 4,486,894 | A | | 12/1984 | Page et al. | |
| 4,549,659 | A | | 10/1985 | Hawkins et al. | |
| 4,566,114 | A | * | 1/1986 | Watt et al. | 378/88 |
| 4,626,688 | A | | 12/1986 | Barnes | |
| 4,731,807 | A | | 3/1988 | Plessis et al. | |
| 4,815,116 | A | * | 3/1989 | Cho | 378/53 |
| 4,848,590 | A | | 7/1989 | Kelly | |
| 5,176,260 | A | | 1/1993 | Oder | |
| 5,676,256 | A | | 10/1997 | Kumar et al. | |
| 5,738,224 | A | | 4/1998 | Sommer, Jr. et al. | |
| 5,794,788 | A | | 8/1998 | Massen | |
| 5,818,899 | A | | 10/1998 | Connolly et al. | |
| 5,841,832 | A | | 11/1998 | Mazess et al. | |
| 5,841,833 | A | | 11/1998 | Mazess et al. | |
| 5,854,821 | A | * | 12/1998 | Chase et al. | 378/53 |
| 5,931,308 | A | | 8/1999 | Gesing et al. | |
| RE36,537 | E | | 2/2000 | Sommer, Jr. et al. | |
| 6,122,343 | A | | 9/2000 | Pidcock | |
| 6,128,365 | A | | 10/2000 | Bechwati et al. | |
| 6,266,390 | B1 | | 7/2001 | Sommer, Jr. et al. | |
| 6,272,230 | B1 | | 8/2001 | Hiraoglu et al. | |
| 6,338,305 | B1 | | 1/2002 | McHenry et al. | |
| RE37,536 | E | | 2/2002 | Barnes | |
| 6,370,223 | B1 | | 4/2002 | Gleason et al. | |
| 6,399,951 | B1 | | 6/2002 | Paulus et al. | |
| 6,453,003 | B1 | | 9/2002 | Springer et al. | |
| 6,519,315 | B2 | | 2/2003 | Sommer, Jr. et al. | |
| 6,545,240 | B2 | | 4/2003 | Kumar | |
| 6,610,981 | B2 | | 8/2003 | Sommer, Jr. | |
| 6,661,867 | B2 | | 12/2003 | Mario et al. | |
| 6,855,901 | B1 | | 2/2005 | Guenard et al. | |
| 6,888,917 | B2 | | 5/2005 | Sommer, Jr. et al. | |
| 7,012,256 | B1 | | 3/2006 | Roos et al. | |
| 7,099,433 | B2 | | 8/2006 | Sommer et al. | |
| 7,200,200 | B2 | | 4/2007 | Laurila et al. | |
| 7,244,941 | B2 | | 7/2007 | Roos et al. | |
| 7,286,634 | B2 | | 10/2007 | Sommer, Jr. et al. | |
| 7,356,115 | B2 | | 4/2008 | Ford et al. | |
| 7,542,873 | B2 | | 6/2009 | Vince et al. | |
| 7,558,370 | B2 | | 7/2009 | Sommer, Jr. et al. | |
| 7,564,943 | B2 | | 7/2009 | Sommer, Jr. et al. | |
| 7,664,225 | B2 | * | 2/2010 | Klein | 378/45 |
| 7,848,484 | B2 | | 12/2010 | Sommer, Jr. et al. | |
| 8,144,831 | B2 | | 3/2012 | Sommer, Jr. et al. | |
| 8,422,630 | B2 | * | 4/2013 | Matoba | 378/58 |
| 2004/0066890 | A1 | | 4/2004 | Dalmijn et al. | |
| 2005/0232391 | A1 | | 10/2005 | Katz | |
| 2010/0185319 | A1 | | 7/2010 | Petzold et al. | |
| 2011/0116596 | A1 | | 5/2011 | Sommer, Jr. et al. | |

FOREIGN PATENT DOCUMENTS

| | | | |
|---|---|---|---|
| EP | 0064810 | A1 | 11/1982 |
| EP | 0484221 | A2 | 5/1992 |
| EP | 0484221 | A3 | 12/1992 |
| EP | 0942295 | A2 | 9/1999 |
| EP | 0942295 | A3 | 11/2001 |
| GB | 2285506 | A | 7/1995 |
| WO | 0109596 | A1 | 2/2001 |

OTHER PUBLICATIONS

"Mercury Emissions from China" (author unknown); http://energy.er.usgs.gov/health_environment/mercury/mercury_china_emissions.html; U.S. Geological Survey; pp. 1-3; Feb. 14, 2010.

"Mercury in Coal" (author unknown); http://energy.er.usgs.gov/health_environment/mercury/mercury_coal.html; U.S. Geological Survey; pp. 1-3; Feb. 14, 2010.

Tako P.R., De Jong et al: "Automatic Sorting and Control in Solid Fuel Processing: Opportunities in European Perspective"; Geologica Belgica; 2004; pp. 325-333; vol. 7/3-4; Geologica Belgica; Brussels, Belgium.

* cited by examiner

| density | 5.0 g/cc | 1.2 g/cc | 2.6 g/cc |
|---|---|---|---|
| Energy (kev) | FeS (Coefficient μ ($cm^{-1}$)) | Coal (Coefficient μ ($cm^{-1}$)) | $SiO_2$ (Coefficient μ ($cm^{-1}$)) |
| 6.00 | 763.20 | 7.730 | 227.10 |
| 8.00 | 963.70 | 3.160 | 99.200 |
| 10.00 | 530.70 | 1.680 | 51.790 |
| 15.00 | 174.17 | 0.570 | 15.830 |
| 20.00 | 77.67 | 0.312 | 6.930 |
| 30.00 | 24.64 | 0.181 | 2.360 |
| 40.00 | 11.06 | 0.147 | 1.250 |
| 50.00 | 6.02 | 0.132 | 0.847 |
| 60.00 | 3.87 | 0.124 | 0.666 |
| 80.00 | 2.08 | 0.114 | 0.547 |
| 100.00 | 1.41 | 0.107 | 0.440 |

Figure 7

| | Percent Transmission | | | |
|---|---|---|---|---|
| Thickness | 1 mm | 1 cm | 1 mm | 10 cm |
| Energy (kev) | FeS | 1 cm Coal | $SiO_2$ | Coal |
| 6.00 | 0.00% | 0.0% | 0.0% | 0.00% |
| 8.00 | 0.00% | 4.2% | 0.0% | 0.00% |
| 10.00 | 0.00% | 18.6% | 0.6% | 0.00% |
| 15.00 | 0.00% | 56.6% | 20.5% | 0.33% |
| 20.00 | 0.00% | 73.2% | 50.0% | 4.40% |
| 30.00 | 8.50% | 83.4% | 79.0% | 16.37% |
| 40.00 | 33.0% | 86.3% | 88.2% | 22.99% |
| 50.00 | 54.8% | 87.6% | 91.9% | 26.71% |
| 60.00 | 67.9% | 88.3% | 93.6% | 28.94% |
| 80.00 | 81.4% | 89.2% | 94.7% | 31.98% |
| 100.00 | 86.9% | 89.9% | 95.7% | 34.30% |

Figure 8

| COLLECTED DATA | Coal (ozs) | Rock (ozs) | TOTAL (ozs) |
|---|---|---|---|
| Coal Product | 26.50 | 6.00 | 32.50 |
| Rock Product | 1.00 | 36 | 37.00 |
| | | | |
| SAMPLE COMPOSITION | 27.50 | 42.00 | 69.50 |

| FRACTION COMPOSITIONS (Purity) | Coal % | Rock % | TOTAL % |
|---|---|---|---|
| Coal Product | 81.5% | 18.5% | 100.0% |
| Rock Product | 2.7% | 97.3% | 100.0% |
| | | | |
| SAMPLE COMPOSITION | 39.6% | 60.4% | 100.0% |

| MATERIALS DISTRIBUTIONS (Recovery) | Coal % | Rock % | TOTAL % |
|---|---|---|---|
| Coal Distribution | 96.4% | 3.6% | 100.0% |
| Rock Distribution | 14.3% | 85.7% | 100.0% |

Figure 9

| COLLECTED DATA | Coal (ozs) | Rock (ozs) | TOTAL (ozs) |
|---|---|---|---|
| Coal Product | 364.25 | 6.00 | 370.25 |
| Rock Product | 13.75 | 36 | 49.75 |
| | | | |
| SAMPLE COMPOSITION | 378.00 | 42.00 | 420.00 |

| FRACTION COMPOSITIONS (Purity) | Coal % | Rock % | TOTAL % |
|---|---|---|---|
| Coal Product | 98.4% | 1.6% | 100.0% |
| Rock Product | 27.6% | 72.4% | 100.0% |
| | | | |
| SAMPLE COMPOSITION | 90.0% | 10.0% | 100.0% |

| MATERIALS DISTRIBUTIONS (Recovery) | Coal % | Rock % | TOTAL % |
|---|---|---|---|
| Coal Distribution | 95.4% | 3.6% | 100.0% |
| Rock Distribution | 14.3% | 85.7% | 100.0% |

Figure 10

METHODS FOR SORTING MATERIALS

This application is a divisional of U.S. patent application Ser. No. 12/712,343, filed Feb. 25, 2010, entitled "Methods for Sorting Materials" which is hereby incorporated by reference in its entirety, which claims the benefit of U.S. Provisional Patent Application Ser. No. 61/208,737, filed Feb. 27, 2009, entitled "Method to Reduce Coal Ash" which is hereby incorporated by reference in its entirety.

Be it known that we, Charles E. Roos, a citizen of the United States, residing at 2507 Ridgewood Drive, Nashville, Tenn. 37215 and Edward J. Sommer, Jr., a citizen of the United States, residing at 5329 General Forrest Court, Nashville, Tenn. 37215, have invented new and useful "Methods for Sorting Materials."

BACKGROUND OF THE INVENTION

Native coals are a mixture of carbon, hydrocarbons, moisture and polluting minerals with higher atomic numbers. Coal generates half of the United States electricity, but utilities face pressure to reduce their carbon footprint and the contamination from mercury, sulfur and coal ash. It is very expensive for the utilities to cleanup ash spills and to provide necessary pollution controls. The United States Environmental Protection Agency is now requiring stricter controls on the emission of mercury and sulfur. Further, new regulations will be imposing an hourly limit on sulfur emissions, rather than an average over twenty four hours. Generally, 60% to 80% of the mercury is associated with the sulfur in iron pyrites. The typical natural content of pollutants in coal used in the U.S. ranges from about 3% percent to 30% with an average of about 10% depending upon the region from which the coal was mined.

The combustion of coal in utility and industrial boilers generates millions of tons of coal ash, slag and sludge. Combustion removes burnable organic constituents but concentrates the naturally occurring radionuclides, which includes uranium, radium thorium and potassium in the ash. Coal ash also contains silicon, aluminum, iron, and calcium. In fact, these elements make up about 90% of the constituents of coal ash. Reduction in mercury emissions are needed to comply with Environmental Protection Agency regulations. Options to reduce mercury emissions include selective mining of coal (avoiding parts of a coal bed that are higher in sulfur and mercury), coal washing (to remove iron pyrite which contains 60% to 80% of the mercury in the coal), post-combustion removal of mercury from the stack emissions or the use of natural gas in place of coal.

Current coal processing uses the difference between the densities of coal and contaminants to remove non-combustibles. Some 95% of coal processing currently uses wet methods. Coal typically has a specific gravity of 1.2 while the rock and heavier minerals have average values of 2.5. Run of the mine coal is typically first reduced to sizes under two inches (5 cm) before it is introduced into a water-magnetite slurry flotation media. The said water slurry has chemicals that raise the specific gravity of the liquid to a value above that of coal. The proportion of magnetite in the water slurry controls the density. The heavier sulfur and silicates sink while the lighter coal floats off.

Wet processing can reduce the ash and sulfur content of the coal, but it wets the processed coal. Furthermore, the liquid media requires treatment in a wastewater treatment facility. Coal fines and water produce sludge with environmental problems. Some processes use acids to remove contaminants and pollute water. The latent heat of water in wet coal reduces the recoverable energy from the combustion of coal by one to two percent. This reduction in useful energy increases the carbon footprint to produce electrical power.

SUMMARY OF THE INVENTION

The present invention discloses methods of sorting materials. The disclosed methods use x-rays to sort ore, such as coal ore, from contaminants, such as sulfur, and the like. Also disclosed are methods of using a calibration bar during the x-ray sorting methods. In certain embodiments, a method of sorting materials, includes providing a sample, reducing a size of the sample to 10 centimeters or less, determining minimum x-ray absorption of a thickest bed depth of the sample, measuring x-ray absorption of pieces of the sample, identifying pieces of the sample having x-ray absorption greater than the minimum x-ray absorption of the thickest bed depth, and sorting from a remainder of the sample the pieces of the sample having x-ray absorption greater than the minimum x-ray absorption of the thickest bed depth. Other embodiments of the invention include identifying pieces of the sample having x-ray percent transmissions that are reduced by 20% or more as compared to the x-ray percent transmission of the minimum x-ray absorption of the thickest bed depth of the sample. Still other embodiments of the invention include measuring x-ray absorption at energies above the K absorption edge of sulfur.

Another embodiment of the invention is a method of reducing sulfur in coal, including, providing a sample of coal ore, reducing a size of the sample to 10 centimeters or less, determining minimum x-ray absorption of a thickest bed depth of the sample for a range of x-ray energies greater than the K absorption edge of sulfur, measuring x-ray absorption of pieces of the sample in the range of x-ray energies greater than the K absorption edge of sulfur, identifying pieces of the sample having x-ray absorption greater than the minimum x-ray absorption of the thickest bed depth, and sorting from a remainder of the sample the pieces of the sample having x-ray absorption greater than the minimum x-ray absorption of the thickest bed depth. Other embodiments of the invention include sorting the pieces of the sample by transporting the sample to an air ejection array, and energizing at least one air ejector of the air ejection array in order to sort the sample based upon the determining. Still other embodiments of the method include using combustion flue gas to reduce fire and explosive hazards.

Still another embodiment of the invention is a method of sorting a material from an ore, including, providing a sample, wherein the sample includes an ore and other materials, irradiating the sample with a plurality of x-ray energies, detecting x-ray absorption values of the ore and materials at a first x-ray energy and a second x-ray energy, determining a range of an atomic number for the ore based upon the x-ray absorption values at the first x-ray energy and the second x-ray energy, determining a range of an atomic number for each of the materials based upon the x-ray absorption values at the first x-ray energy and the second x-ray energy, determining whether the atomic number of a piece of sample is higher than the atomic number for the ore, and sorting the piece of the sample based upon such determination. Other embodiments of the method include determining whether the atomic number of the piece of the sample is greater than the atomic number for the ore by at least 4. In still other embodiments of the invention, sorting the pieces of the sample further includes transporting the sample to an air ejection array, and energizing at least one air ejector of the air ejection array in order to sort the sample based upon the determining. In yet other embodiments of the invention, detecting x-ray absorption values further includes transporting the sample between an x-ray source and an x-ray detector. In certain embodiments, the ore is coal, and the materials are metallic inclusions in the ore.

Yet another embodiment of the invention is a method of providing a calibration bar having the same x-ray absorption as the maximum bed depth of the processed coal by means of measuring the atomic composition of the coal and making a device of "clean coal" with the same proportional atomic composition of elements with atomic number less than 10. Yet another embodiment of the invention is a method of sorting materials, including, providing a calibration bar, irradiating the calibration bar with x-rays, calibrating an x-ray sensing device so that detection of an x-ray percent transmission of a sample lower than the x-ray percent transmission of the calibration bar determines that the sample is to be sorted, analyzing the sample, and sorting the sample. Other embodiments of the method include determining a bed depth of the x-ray sensing device. Still other embodiments of the invention include selecting the calibration bar based upon such determination of the bed depth. In yet other embodiments of the invention, analyzing the sample further includes detecting x-ray absorption values for the pieces of the sample, determining whether any pieces of the sample have an x-ray percent transmission that is reduced by 20% or more as compared to the x-ray percent transmission of the calibration bar, and identifying the pieces of the sample having x-ray percent transmissions that are reduced by 20% or more as compared to the x-ray percent transmission of the calibration bar so that such pieces of the sample are sorted. In still other embodiments of the invention, the calibration bar has atomic mass absorption coefficients in proportion to the distribution of elements of the sample having atomic number of 10 or less.

Accordingly, one provision of the invention is to provide a method of sorting coal ore from contaminants.

Still another provision of the invention is to provide methods of using x-ray energies for sorting materials.

Yet another provision of the invention is to provide a calibration bar for use during the methods of sorting materials.

BRIEF DESCRIPTION OF THE DRAWINGS

FIG. 7 shows the linear absorption coefficients from the National Institute of Standards and Technology for iron pyrite (FeS), coal, and silicon dioxide ($SiO_2$) over a range of x-ray energies. Also shown are their densities. Coal differs from mine to mine and even within the same coal vine; there is no standard definition for coal. The absorption shown for coal is the NIST value for graphite reduced to the 1.2 density of typical bituminous coal.

FIG. 8 shows the percent transmission of the materials listed over a range of x-ray energies, as calculated from the National Institute of Standards and Technology absorption coefficient information.

FIG. 9 shows the results of the analysis performed in Example 4.

FIG. 10 shows the results of the analysis performed in Example 5.

DETAILED DESCRIPTION OF THE INVENTION

Figure 1:
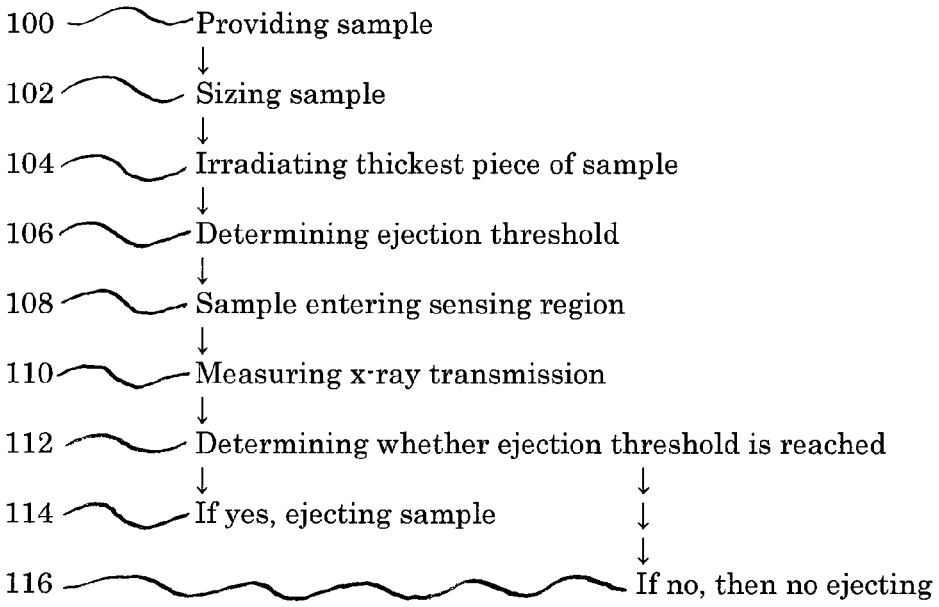
FIG. 1 shows a flowchart of an embodiment of a method disclosed herein. Shown therein are the steps of a method of sorting materials.

The present invention discloses methods of sorting contaminants away from coal. The methods disclose the use of specific x-ray energies to detect contaminants, such as sulfur, mercury, iron, and the like, within coal pieces so that such contaminants may be sorted away from other pieces of coal not having contaminants. Briefly, the methods disclosed herein include the steps of crushing larger pieces of coal as needed, analyzing pieces of coal at very rapid rates, and sorting away the pieces of coal having inclusions of contaminants, which are undesired.

The methods disclosed herein may be used to "clean" coal so that sulfur, mercury, and the like, are reduced when the coal is used at a coal burning power plant. There are several benefits from the use of methods of removing contaminants from coal in order to provide a cost effective dry method to significantly reduce the amount of contaminants (for example, sulfur) below the levels available with current washing techniques. For example, cleaner coal improves blower performance by reducing slag and corrosion problems. Also the herein disclosed dry processing method reduces the amount of water used in processing coal for washing reducing requirements for waste water treatment. Further, the "clean" coal's higher heating value increases boiler capacity. Also, the total amount of ash is reduced and less sensible heat is lost to moisture and the bottom ash. The energy requirements of the flue gas desulfurization (FGD) can be up to 10% of the electrical power production of a coal burning plant. FGD systems generally have much better operation and lower power loss with cleaner low sulfur coal. The consistent low sulfur levels make it easier for the FGD system to comply with the EPA hourly limits for sulfur emission. Accordingly, the increase in energy efficiency expected by the methods disclosed herein is expected to provide a direct reduction in the carbon footprint per kilowatt. The methods disclosed herein provide cost effective methods to remove contaminants from coal which, when burned, will significantly reduce the pollution and carbon footprint of the electrical production.

By way of background, x-ray absorption in a material is a function of the density and atomic number of the material and it is also a function of the energy of the incident x-rays. A given piece of material will absorb x-rays to differing degrees depending upon the energy of the incident x-rays. Materials of differing atomic numbers will absorb x-rays differently. For example, materials having a higher atomic number will absorb x-rays much more readily than will materials having a lower atomic number. Also, the absorption profile of a given material over a range of x-ray energies will be different than the absorption profile of another material over that same range of energies. X-ray transmission through a material is given by the equation $N_{(t)}=N_0e^{-\eta\rho t}$, where $N_{(t)}$ is the number of photons remaining from an initial $N_0$ photons after traveling through thickness t in a material of density ρ. The mass attenuation coefficient η is a property of the given material and has a dependence upon photon energy. The value ηρ is referred to as the linear absorption coefficient (μ) for a given material. Values of the coefficient μ have been established by researchers to high accuracy for most materials and these values are dependent upon the energy of incident x-ray photons. Values of μ/ρ (=η) for most elements can be found at the National Institute of Standards and Technology (NIST) internet website. The lists of values are extensive covering all stable elements for various values of photon energy (for example, a kilo electron volt, abbreviated as KeV). The value of ρ for a given material is simply its density in gram/$cm^3$ and can be found in many textbooks and also at the NIST website. The ratio $N_{(t)}/N_0$ is the transmittance of photons through a thickness t of material and is often given as a percentage, i.e. the percentage of photons transmitted through the material.

A material's absorption curve could prove sufficient for identification and sortation. However, certainty during the identification process may be augmented by fluorescence information. When x-rays pass through a material, some x-rays with energies greater than the electron excitation energy of constituent elements are absorbed and some of the energy in the excited atom is re-emitted as fluoresced photons. This sharp jump in absorption for x-rays with sufficient energy to eject electrons from the atom is called the "absorption edge." The fluorescent radiation is isotropic and has a lower energy than the edge. The present invention uses x-rays with energy above the absorption edge for sulfur but it does not use x-ray fluorescence.

In certain embodiments of the present invention, the method of sorting materials includes providing a sample, reducing the pieces of the sample to an appropriate size, setting the detection thresholds, and sorting the sample according to the sorting parameters. Disclosed herein are the various embodiments for practicing the methods disclosed. By way of background, U.S. patents for various x-ray measuring systems include U.S. Pat. No. 7,564,943 issued to Sommer, et al. on Jul. 21, 2009; U.S. Pat. No. 7,099,433 issued to Sommer, et al. on Aug. 29, 2006; RE36537 issued to Sommer et al. on Feb. 1, 2000; U.S. Pat. No. 5,738,224 issued to Sommer et al. on Apr. 14, 1998; U.S. Pat. No. 7,664,225 issued to Klein on Feb. 16, 2010; U.S. Pat. No. 6,338,305 issued to McHenry, et al. on Jan. 15, 2002; U.S. Pat. No. 7,542,873 issued to Vince, et al. on Jun. 2, 2009; U.S. Pat. No. 7,200,200 issued to Laurila, et al. on Apr. 3, 2007; U.S. Pat. No. 5,818,899 issued to Connolly, et al. on Oct. 6, 1998; U.S. Pat. No. 4,486,894 issued to Page, et al. on Dec. 4, 1984; U.S. Pat. No. 4,090,074 issued to Watt, et al. on May 16, 1978; and U.S. Pat. No. 4,377,392 issued to Massey, et al. on Mar. 22, 1983, each of which is hereby incorporated by reference in its entirety.

Referring now to FIG. 1, there is shown an embodiment of the method of sorting contaminants from coal. The method starts by providing a sample 100. The sample consists of a mixture of pieces of coal. Some pieces have large inclusions of contaminants and others have none or only very small inclusions. By way of illustration, but not limitation, examples of contaminants include sulfur, mercury, silicates, carbonates, iron, calcium, aluminum, and the like. The sample then goes through a sizing 102 procedure in order to reduce the size of the pieces of the sample to an appropriate size, as further described herein. In order to set the parameters of analysis, an individual piece of the sample which is representative of the thickest piece or thickest bed depth is selected for irradiating 104. The thickest bed depth refers to the bed depth of the machine being used for processing. The bed is the portion of the machine on which the sample passes, as known to those of skill in the art. Accordingly, in certain embodiments disclosed herein, the methods include determining minimum x-ray absorption of the thickest bed depth of a sample. Determining the ejection threshold 106 is accomplished by first irradiating the thickest piece of the sample, or thickest bed depth, with a range of x-ray energies as disclosed and using the maximum signals to calibrate the pixels in the detector array. In certain embodiments of the method, the range of x-ray energies is the range of x-ray energies greater than the K absorption edge of sulfur. A detector threshold can be defined as a percent (for example 80%) of the signal voltage from the thickest regions of the sample of coal, without any inclusions of contaminants. The ejection threshold is then set as a percentage of pixel readings during the measurement cycle that have signals less than the detector threshold. The number of pixel signals with levels less than the threshold sets the minimum size of the ejected contaminate. A detector with 25 pixels/cm can detect 0.4 mm objects. Ejecting on a single low pixel reading could reduce contaminates to 100 ppm. While ejection on a pixel may be useful for extracting gold for base rock, a more typical requirement for coal could be 250 pixels with low signals out of the typical 650 pixel signals per square cm of the sample. Next, sample entering a sensing region 108 is irradiated, as disclosed herein, so that there is measuring of x-ray transmission 110. After measuring x-ray transmission, the next step is determining whether the ejection threshold is reached 112. If the ejection threshold is reached, then ejecting of the sample 114 occurs. If the ejection threshold is not reached, then there is no ejecting 116 of the sample.

In certain embodiments, providing the sample may include providing run of mine ore from a coal mine. In other embodiments, the sample may be coal that has already been subjected to some cleaning method or procedure. In still other embodiments, the sample to be subjected to the methods disclosed herein may be any ore material containing a contaminant. For example, ore which contains gold may be subjected to this method in order to separate the gold. In certain embodiments, the methods disclosed herein may be useful in mining applications for processing of ores for minerals and metals. Mining ores are often silicates with metallic inclusions. The metallic inclusions have higher linear x-ray absorption coefficients. Accordingly, if gold ore is crushed, then the small gold inclusions could be detected and ejected by use of the present methods.

Regarding sizing of the sample, methods are well known in the industry for crushing, or reducing the size of larger pieces of ore so that they are properly sized for processing through an x-ray machine, or device, as described herein. One of ordinary skill in the art is familiar with such crushing, or resizing, machines, which are readily commercially available. In certain embodiments of the present invention, it is advantageous to size the sample into pieces having a thickness of 10 cm or less. In other embodiments of the present invention, it is appropriate to size the sample into pieces having a thickness of 3 inches, 2 inches, or 1 inch, or less. Size is usually not a factor in quality of sorted coal since the coal is typically ground into fine powder (often called coal fines) before use in electrical power plants. Also it is noteworthy that coal is easier to fracture than iron pyrites and silicates. In certain embodiments, reducing the coal thickness to less than 5 cm makes it easier to use.

In certain embodiments of the present invention, the range of x-ray energies used is dependent upon the thickness of the sample, or the thickness of the bed depth. In certain embodiments, the range of x-ray energies may be from about 6 KeV to about 100 KeV. In other embodiments, the x-ray energies may be in the range of from about 8 KeV to about 20 KeV. In still other embodiments, the range of x-ray energies may be from about 50 KeV to about 100 KeV. In still other embodiments, the range of x-ray energies is above the absorption edge of the ejected element. In still other embodiments, the x-ray energy that may be used are those provided within the Tables of this application. Various devices may be appropriate to supply the x-ray energies and x-ray detectors used in the methods disclosed herein. In certain embodiments of the present invention, such a device may be the zSort machine, second generation, commercially available from National Recovery Technologies, Inc. of Nashville, Tenn. In other embodiments, an appropriate x-ray device is available from Commodas Mining GmbH at Feldstrasse 128, 22880 Wedel, Hamburg, Germany, and is called the CommodasUltrasort. It uses dual-energy detection algorithms similar to airport baggage scanners. In other embodiments of the method, a device having the ability to eject small contaminates from a mixture of coal that has sizes ranging between 10 cm and 0.004 cm may be used. In still other embodiments, an appropriate x-ray sensing device may be model no. DXRT which is commercially available from National Recovery Technologies, Inc. of Nashville, Tenn. The x-ray sensing machine may be a dual energy device. In other embodiments of the present invention, the x-ray device may be a broadband x-ray device such as the vinyl cycle model, which is commercially available from National Recovery Technologies, Inc. of Nashville, Tenn. In still other embodiments of the present invention, the x-ray sensing device may be properly equipped with an inert air filtering system to ensure that coal dust is removed and is not inadvertently ignited. Accordingly, the use of the exhaust combustion gas from other devices is a safety precaution that can ensure that ignition is avoided. In other embodiments of the method, use of heaters to reduce the moisture in ROM coal and the exhaust from diesel engines is included.

In certain embodiments, the use of dual energy detectors permits determination of relative composition independent of coal thickness. In certain embodiments of the present invention, a complex pattern of matching size measurements of the coal sample is not needed, although it is preferred that the pieces of the sample have sizes less than the average bed depth of the coal sample. Stated another way, the methods disclosed herein operate to identify materials by differences in x-ray absorption and reliably provide signals to rapid ejection mechanisms.

With regard to determining an ejection threshold 106, applicants note that ejection is just one of several appropriate methods of physically separating pieces of the sample. In certain embodiments of the present invention, separation may occur by use of an array of air ejectors, as further described herein. In still other embodiments of the present invention, separation may occur by pushing, moving, or otherwise, thrusting a piece of sample which has reached an ejection threshold so that it is physically separated from a piece of sample which has not reached the ejection threshold. Such pushing or moving may occur by use of fast acting pistons, mechanical levers, or flippers. One of ordinary skill in the art is familiar with various arms, hydraulics, or the like which may be used to physically move a piece of sample which has reached the ejection threshold.

In certain embodiments of the present invention, the threshold which is indicative of the presence of a contaminant (i.e., the ejection threshold), is determined by the percent transmission of the piece of sample being substantially lower than the percent transmission of the thickest piece of the ore sample. In certain embodiments of the present invention, such a substantially lower percent transmission of the x-rays through the sample may be expressed as being a reduction of 20% or more. In still other embodiments of the present invention, a percent transmission which is 50% lower than the percent transmission of the thickest piece of the sample is indicative of the ejection threshold being reached. In still other embodiments of the present invention, 40 KeV x-rays have 61% of the transmission through 0.04 cm copper inclusions as 1.0 cm of silicate rock.

Applicants note that the relative atomic number of a material relates to the absorption of x-rays of that material. Accordingly, when referring to the absorption of x-rays, it may be expressed by commenting upon the percent transmission of x-rays through such material, or by commenting upon the absorption of the materials of the x-rays exposed to the materials. To be clear, a material, such as a contaminant, which has a reduced percent transmission of x-rays is a material which has higher x-ray absorption. In certain embodiments of the present invention, a dual energy x-ray detector array may be used to measure x-ray transmission values through materials over two energy ranges. In certain embodiments, either of the x-ray transmission values may be used to determine the threshold which is indicative of the presence of a contaminant by reducing the percent transmission as described above. In alternate embodiments, the x-ray transmission values at two energy ranges may be used to determine a range in which the material's atomic number is found. Then, the decision of whether the piece of sample should be ejected is made by determining whether the material's atomic number is higher than the atomic number of the coal that is being separated. In still other embodiments of the present method, a device measuring a plurality of energies may be used to determine a range in which a material's atomic number exists.

The x-ray detection systems described herein have recordable devices, such as microprocessors, controllers, computers, or the like, in order to allow the machines to make determinations and perform functions. One of ordinary skill in the art is familiar with adjusting, manipulating, or programming such devices in order to achieve the methods set forth herein. By way of example, the DXRT model commercially available from National Recovery Technologies, Inc. of Nashville, Tenn., is programmable such that ejection thresholds may be set. In this example, the DXRT machine calculates position and timing information for arrival of the piece of sample at the air ejection array needed to accurately energize downstream ejector mechanisms in the air ejection array and issues the necessary commands at the right time to energize the appropriate ejectors to eject the piece of sample having a contaminant from the flow of other pieces of sample which do not have a contaminant. Accordingly, pieces of sample having sufficiently high percent transmissions are not ejected by the air ejection array. In alternate embodiments, the machine may be set such that the opposite is true. That is, ore containing no contaminants are ejected and pieces of ore containing contaminants are not ejected. Those of ordinary skill in the art recognize that such alterations to the methods disclosed herein may be performed.

Still referring to the methods disclosed herein, after a decision is made that a contaminant is present and should be ejected, then next determination regards what amount of area needs to be ejected. Some x-ray sensing devices have a capacity of 32 linear pixels per inch. Other x-ray sensing devices have a capacity of 64 linear pixels per inch. The ejection area size may be set based upon a required number of pixels detecting a contaminant. For example, if a device having 32 linear pixels per inch is in use and it is desired to eject areas of one square inch, then it could be required that 1000 continuous pixels would need to detect a contaminant in order for the air ejector to be triggered to take action. In certain embodiments, if there is one air jet for each 25 pixels and the recovery time is a millisecond, then there can be 500 measurements for each square centimeter of a conveyor belt traveling at 2 meters per second. The number of pixel readings having reduced x-ray transmissions required to initiate a blast of air for ejection determines the minimum size of the ejected contaminant. The required pixel number is an adjustable perimeter within the method. With the example above, one of ordinary skill in the art may adjust the perimeter to their specific needs. Accordingly, if economic value is provided by removing smaller contaminant inclusions, then the methods disclosed herein may be used.

Figure 2:
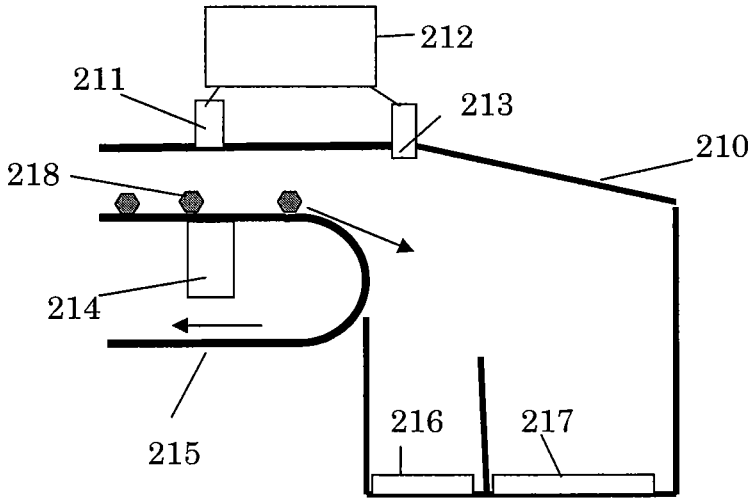
FIG. 2 shows a schematic diagram of side view of an embodiment of a device for practicing the methods disclosed herein. Shown therein is a conveyor belt for transporting coal between an x-ray source and an x-ray detector. Also shown is a computer and ejector system for separating the coal into the areas shown.

Referring to FIG. 2, there is shown a side view of an embodiment of a device for practicing the methods disclosed herein. Shown therein is coal 218 located on a conveyor belt 215 inside a sorter enclosure 210. As the coal 218 passes between the x-ray source 214 and the x-ray detector 211 the coal is irradiated. The x-ray detector 211 is operationally connected to a computer 212 which directs the air ejector 213 to send contaminated coal to the contaminated coal conveyor 216. Coal 218 that is not ejected is collected on conveyor belt 217. As previously disclosed herein, the computer has software, or other means in order to perform the steps indicated herein. In certain embodiments, the determination may be as simple as material having an atomic number of greater than 10 is ejected.

Figure 3:
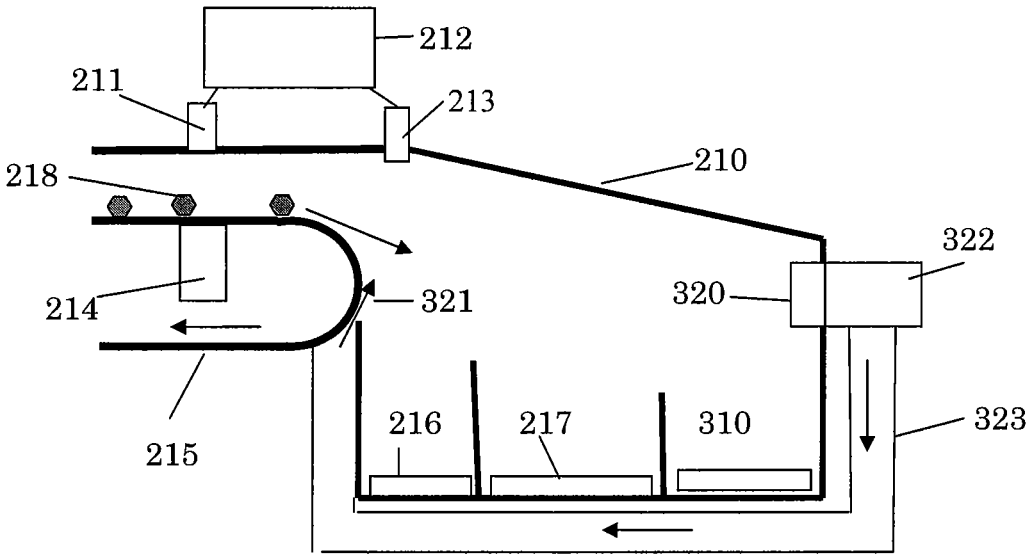
FIG. 3 is a side view of a schematic diagram of an embodiment of a device for practicing the methods disclosed herein. Specifically, shown therein is an air knife which is used to separate the very small particles of coal, often called coal fines, from the larger particles of the coal sample. As shown therein, the coal sample is separate into three separate groups.

Referring now to FIG. 3, there is shown an embodiment of a device for practicing the methods disclosed herein. Specifically the side view shows the device described in FIG. 2. In addition to the elements shown in FIG. 2, FIG. 3 includes the addition of an air knife 321 which is used to direct the small particles of sample, referred to as coal fines, out of the stream of larger pieces of sample. The air knife does so with a thin sheet of air in order to divert those small pieces of sample to a third conveyor 310 for the coal fines. Removal of these very small particles provides for a cleaner processed coal, which is captured on conveyer belt 217. In operation, the air knife 321 includes a fan 322, a filter 320, and a transportation pipe 323 for the air. The small particles of sample which are ejected by the air knife are collected on the filter 320 and dropped on the conveyor belt 310. The separated small particles of the sample can then be further processed by various means described herein.

Figure 4:
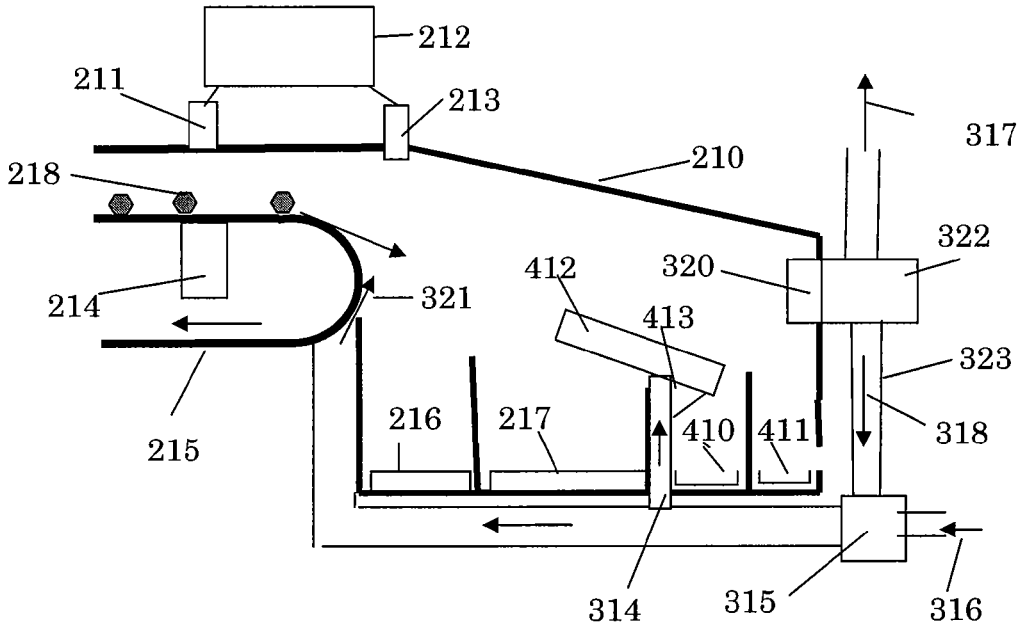
FIG. 4 is a schematic diagram of a side view of an embodiment of a device for practicing the methods disclosed herein. With regard to the separation of coal fines, the embodiments includes an air table for further separating coal fines having metallic contaminants from coal fines not having metallic contaminants. Accordingly, a coal sample is separated into the 4 groupings shown in the Figure. Another embodiment shown in the figure is the use of combustion air to reduce the fire and explosion hazards of coal dust.
Figure 5:
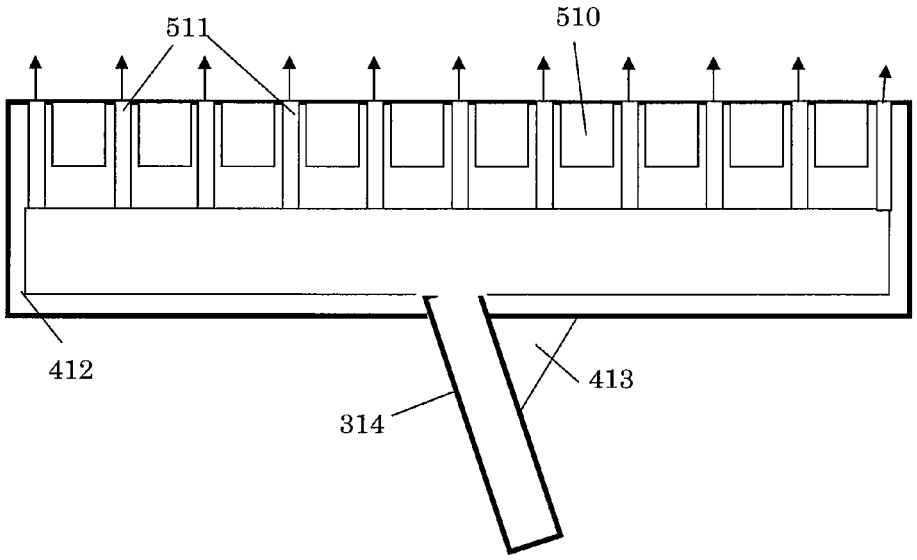
FIG. 5 is a schematic cross sectional view of the air table shown in FIG. 4. Shown therein is the vibrator, air jets, and magnets.

Referring now to FIG. 4, there is shown an alternate embodiment for practicing the methods disclosed herein. The present embodiment shows the addition of an air table 412 and means to reduce fire hazards using combustion flue gas 316 from motors and heaters. In other embodiments, use of the air table 412 is independent and separate from the use of combustion flue gas 316. In still other embodiments, the use of combustion flue gas 316 is independent and separate from the use of the air table 412. As shown in the figure, the air table 412 connects to the air transportation pipe 323 with the pipe 314 which includes magnets and small air jets to collect and slide the heavier magnetic components (i.e., the contaminants) in the coal fines to the conveyor belt 410 for the contaminated coal fines. Vibration of the air table 412 by vibrator 413 helps to move the deposited fines off the table. The filter 320 collects the nonmagnetic coal fines, which drop onto conveyor belt 411. Portions of the circulating air from the exhaust blower 322 are vented to the atmosphere 317 while the remaining air 318 is mixed with flue gas 316 and recirculated by the fan 315. The combustion air from motors and heaters used for coal processing can be used to provide a fire resistant atmosphere to reduce the explosion hazard from coal dust in the sorting device. The cleaner fines can then be combined with the larger coal which has been processed by the x-ray methods disclosed herein. Referring now to FIG. 5, there is shown an enlarged schematic cross-section view of the air table 412. Shown therein is the vibrator 413, the air pipe 314, and the magnets 510 and air jets 511.

Figure 6:
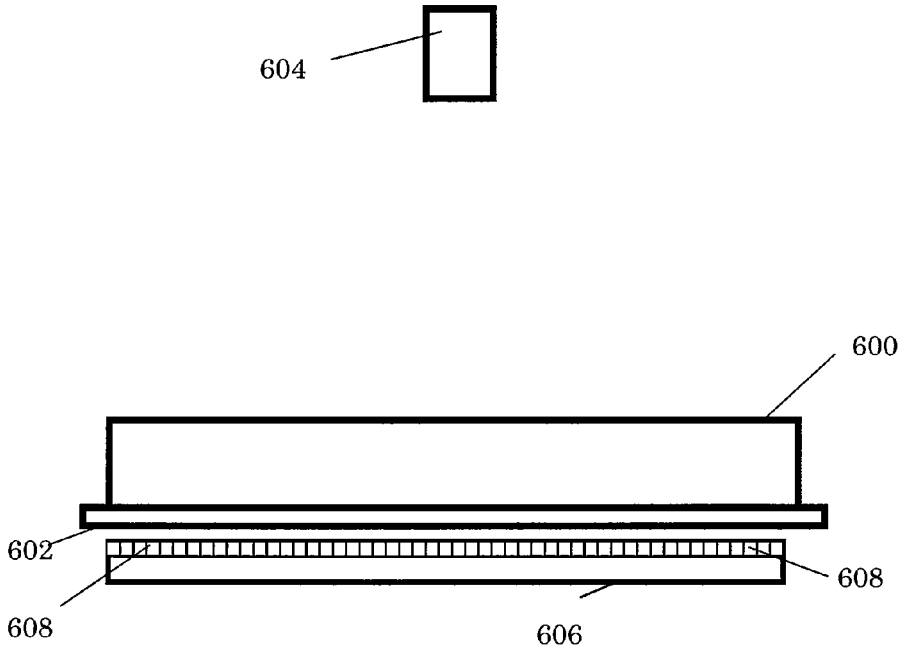
FIG. 6 is a schematic diagram of a cross section of an end view of an x-ray measuring device having a calibration bar in place on its conveyor belt. The calibration bar is located between the x-ray source and the detector array.

In an alternate embodiment of the present invention, rather than performing the first step of measuring the percent transmission of the thickest piece of the sample, the first step may be to use a calibration bar 600. Referring now to FIG. 6, there is shown a cross section of an end view of an x-ray measuring device having a calibration bar 600 in place on its conveyor belt 602. The calibration bar 600 is located between the x-ray source 604 and the detector array 606 having pixels 608. While based upon a given x-ray energy range and x-ray machine bed depth, a calibration bar 600 is used to provide a percent transmission below which is to be considered as a contaminant value. Because various x-ray energy range and x-ray machine bed depth perimeters require that the calibration bar 600 be constructed of different material, the composition of the calibration bar 600 changes. In certain embodiments, the calibration bar 600 may consist of plastic mixtures of hydrocarbons and carbohydrates with graphite. As known to one of ordinary skill in the art, molding techniques may be used to shape the plastic and graphite composition of the calibration bar 600 to an appropriate size and shape so that it fits within the x-ray measuring device and is a length sufficient to cover the width of the conveyor belt in order to reach all sensors. In certain embodiments, the information in any of the figures may be used to construct a calibration bar 600 for use with the given x-ray energy range and x-ray machine bed depth perimeters. The methods disclosed include the step of measuring bed depth of an x-ray sensing device in order to determine the bed depth as it relates to use of the calibration bar 600. In certain embodiments of the invention, the calibration bar 600 is to have the same x-ray absorption as the maximum bed depths of coal without contaminates. In other embodiments, the calibration bar 600 has atomic mass absorption coefficients in proportion to the distribution of elements of the sample having atomic number or 10 or less. The elemental composition of air dried coal from a mine can be determined by standard methods and used to construct a device with the same x-ray absorption as the sample bed depth of the lighter elements with atomic number less than 10 from a mixture of hydrocarbons, carbohydrates and carbon. For example, if mean elemental composition of air dried ROM coal is 55% carbon, 8% hydrogen, 28% oxygen, 7% silicon and 4% sulfur and metals, the air dried composition without silicates, sulfates and metal is 67% carbon, 7.3% hydrogen and 25.6% oxygen and a calibration bar 600 with this atomic composition and the thickness of the bed depth permits rapid calibration of said ROM coal. The calibration bar 600 is used to calibrate the coal sorter. In an alternate embodiment of processing gold ore, the calibration bar 600 is designed for the x-ray absorption of the bed depth of the residue granite rock. As best seen in FIG. 6, the calibration bar 600 is used by placing it in the path of the x-rays. The percentage transmission information is saved by the machine and used to normalize the voltage output of each pixel in the x-ray detector array. The ejection threshold can be set by the number of pixels with voltages that measure a set percent transmission that is less than the transmission of the calibration bar. The pixel number and the percentage of the threshold are adjustable perimeters that can be set manually, or automatically in the x-ray measuring device.

EXAMPLES

Example 1

Linear Absorption Coefficient

Shown in FIG. 7 are the linear absorption coefficients from the National Institute of Standards and Technology (NIST) mass absorption coefficients (μ) for iron pyrite (FeS), coal, and silicon dioxide ($SiO_2$) over a range of x-ray energies. Also shown are their densities. Note that coal is a mixture of carbon and hydrocarbons and there is no NIST "standard" for coal. Accordingly, the x-ray absorption coefficients of coal are the NIST data for graphite corrected for coal density of 1.2 grams per cubic centimeter (g/cc). As shown elsewhere herein, the absorption by coal is much less than the absorption of pyrite in silicates for 8 to 20 kilo electron volts (KeV) x-rays. Using the information in FIG. 7 illustrates how a contaminant can be differentiated from coal.

Example 2

X-Ray Transmission Percentages at Various Energies

The methods disclosed herein use x-ray energies that permit selection of contaminants for ejection while providing detectable transmission through coal. As a first step, run-of-mine coal is reduced to sizes of less than five centimeters in order to provide significant transmission through the coal samples while the opaque contaminants, such as sulfide and silicates, are detected by the reduced percentage of transmission of the x-rays through those materials. Shown in FIG. 8 are percent transmissions calculated from NIST absorption coefficient information.

As best seen in FIG. 8, coal allows for transmission of x-ray energies very readily as compared to the transmissions allowed by the other materials. For example, it is calculated that use of x-ray energy at a level of 15 KeV results in a 56.6% transmission through coal having a thickness of 1 cm, while contaminants having a thickness of only 1 mm have reduced transmission percentages of 0% (for FeS), and 20.5% (for $SiO_2$). By way of a second example, it is calculated that use of x-rays at an energy level of 20 KeV for which coal having a thickness of 1 cm has a transmission percentage of 73.2%, as compared to contaminants such as FeS and $SiO_2$ which have transmission percentages of 0% and 50%, respectively.

Example 3

Separation of Contaminants from Coal

A 100 pound sample of wet washed coal was subjected to the following method in order to separate contaminants from the coal. The sample was sundried in order to remove moisture remaining from the wet washing procedure. After sun-drying, the sample was reduced to individual pieces having size less than 10 cm. One of the pieces of the sample was placed on a x-ray scanning device, a baggage scanner, commercially available from Smiths Detection of Danbury, Conn., as model no. 7555. The x-ray device was adjusted to detect x-ray energies up to 160 KeV. The transmission through an individual piece of the sample was determined at two energy ranges. The x-ray detectors, which receive the x-ray energy transmission, were set so that the transmission through the coal resulted in correlation of transmission at the two energy ranges giving an approximate atomic number of less than 10. As noted in this application, since contaminants within the coal have higher absorption coefficients, such contaminants will result in reduced percentages of transmission of the x-rays through the material yielding higher atomic numbers in the scanning device. The coal sample was placed in the scanner in order to scan the pieces of the sample for transmission percentage values. The pieces within the coal sample that had inclusions with reduced x-ray transmission were put in a "reject" portion. Approximately 10% of the sample had detectable inclusions and was placed in the "rejected" population. Both portions of the sample were analyzed as further described below. Such analysis is commonly commercially available. Such a provider is Hawkmtn Labs, Inc. of Hazle Township, Pa. The "rejected" portion of the sample contained the following characteristics, as measured by the referenced ASTM International standard protocols: percent moisture (ASTM D5142): 6.05%; percent ash (ASTM D5142): 12.62%; BTU/lb (ASTM D5865): 11834; percent sulfur (ASTM D4239): 6.59%; and mercury: 0.552 micrograms/gram. In contrast, the portion of the coal sample which was not rejected had the following characteristics: percent moisture (ASTM D5142): 5.75%; percent ash (ASTM D5142): 7.05%; BTU/lb (ASTM D5865): 12846; percent sulfur (ASTM D4239): 1.32%; and mercury: 0.091 micrograms/gram. As noted, the "rejected" portion has higher levels of percent ash, percent sulfur, and mercury. Also, the sulfur in the portion of the coal sample that was not rejected was 1.027 lb/MBTU while the "rejected" portion was 5.569 lb/MBTU.

Example 4

Separation of Rocks from Coal

A sample including a mixture of coal and rock, ranging in size from one-quarter inch to one inch was analyzed. After setting up the thresholds, as further described below, the sample was fed through a differential x-ray sorting machine. Such a machine is commercially available from National Recovery Technologies, Inc. of Nashville, Tenn., as a model called the zSort. The sample was processed through the machine at a processing speed of 6 feet per second. Setting the thresholds of the machine includes the steps, in one embodiment, of placing said calibration bar on the conveyor belt and measuring the mean signal voltages and normalizing the signal voltage of all detector pixels to said mean pixel signal voltage signals from x-rays transmitted through said calibration bar.

The results of the experiment are best seen in FIG. 9. The tested sample consisted of approximately 27.5 ounces of coal and 42 ounces of rock. That is about 40% coal and 60% rock. As the sample was fed through the machine it was set to sort the coal into one destination and the rock into another destination. As best seen in FIG. 9, the coal destination consisted of 95.4% coal and 3.6% rock.

Example 5

Separation of Rocks from Coal

Another sample consisting of 378 ounces of coal and 42 ounces of rock was analyzed according to the steps described in Example 4. The sample mixture was of about 90% coal and about 10% rock. As best seen in FIG. 10, sorting resulting in material being placed in the coal destination, that material being 96.4% coal and 3.6% rock. Also shown is that of the material reaching the rock destination 85.7% of that was rock and 14.3% was coal. It is believed that the 14.3% of rock that was not ejected into the rock destination was due mostly to valve timing issues and not detection issues. Clearly the method disclosed herein efficiently and consistently separates rock from coal.

Regarding the through put volume of the machine, it is noted that the sample (1.7 pounds) was spread over the surface in a single layer density. The loading of such a sample yields a thru-put rate of approximately 9 tons per hour for a 24 inch wide zSort machine, or 36 tons per hour for a 96 inch wide zSort machine. Assume an ejection footprint of a one $inch^2$ air blast at the feed stream surface. Belt speed is 72 inch/second so that the feed stream moves at 0.072 inch/millisecond. Assume a valve on time of about 10 milliseconds so that the stream moves about 0.7 inch during an ejection giving an ejection profile 1.7 inches long. Then, 1.7 $inch^2$ of feed stream surface area is ejected for each ejection. In this case there are 24 such ejections per 28 inches of belt length so that $24 \times 1.7$ $in^2$ of material is ejected. The corresponding feed stream surface area is 672 $inch^2$ so one can estimate that 6% of the feed stream area is ejected. In any one ejection assume that ⅓ of the ejected area is rock and that ⅔ is coal. If the coal is evenly distributed then one can estimate that about 4% of the coal will be ejected along with the 95%-99% ejection rate of the rock for a processing rate of 36 ton per hour on a 96 inch wide zSort unit. Accordingly, referring to FIG. 10, the projected coal product would be 98.4% coal and 1.6% rock. With regard to larger sized pieces, the processing capacity will effectively increase linearly as particle size increases. For example, if the normal size of the material is 1.5 inches then processing capacity will increase by a factor of two. If coal size is 3 inches, then processing capacity will increase by a factor of four. Accordingly, it is estimated that processing particle sizes of 1.5 inches would result in a capacity of 72 tons per hour for a 96 inch unit. Also, it is estimated that processing particle sizes of 3 inches would result in a processing capacity of 144 tons per hour for a 96 inch unit.

All references, publications, and patents disclosed herein are expressly incorporated by reference.

Thus, it is seen that the methods of the present invention readily achieve the ends and advantages mentioned as well as those inherent therein. While certain preferred embodiments of the invention have been illustrated and described for purposes of the present disclosure, numerous changes in the methods may be made by those skilled in the art, which changes are encompassed within the scope and spirit of the present invention as defined by the following claims.

What is claimed is:

1. A method of sorting a material from an ore, comprising:

providing a sample, wherein the sample includes an ore and other materials;

irradiating the sample with a plurality of x-ray energies;

detecting x-ray absorption values of the ore and materials at a first x-ray energy and a second x-ray energy;

determining a range of an atomic number for the ore based upon the x-ray absorption values at the first x-ray energy and the second x-ray energy;

determining a range of an atomic number for each of the materials based upon the x-ray absorption values at the first x-ray energy and the second x-ray energy;

determining whether the atomic number of a piece of sample is higher than the atomic number for the ore;

sorting the piece of the sample based upon such determination.

2. The method of claim 1, wherein determining whether the atomic number of the piece of the sample is higher than the atomic number for the ore is determining whether the atomic number of the piece of the sample is greater than the atomic number for the ore by at least 4.

3. The method of claim 1, wherein sorting the pieces of the sample further comprises:

transporting the sample to an air ejection array; and energizing at least one air ejector of the air ejection array in order to sort the sample based upon the determining.

4. The method of claim 1, wherein detecting x-ray absorption values further comprises transporting the sample between an x-ray source and an x-ray detector.

5. The method of claim 1, wherein the ore is coal.

6. The method of claim 1, wherein the materials are metallic inclusions in the ore.

* * * * *